US006612942B1

(12) United States Patent
Battersby et al.

(10) Patent No.: US 6,612,942 B1
(45) Date of Patent: Sep. 2, 2003

(54) BALL FOR PITCHING MACHINE

(75) Inventors: Gregory J. Battersby, Westport, CT (US); Charles W. Grimes, Darien, CT (US)

(73) Assignee: ProBatter Sports, LLC, Milford, CT (US)

( * ) Notice: Subject to any disclaimer, the term of this patent is extended or adjusted under 35 U.S.C. 154(b) by 0 days.

(21) Appl. No.: 09/542,902

(22) Filed: Apr. 4, 2000

(51) Int. Cl.[7] ..... A63B 69/00; F41B 15/00

(52) U.S. Cl. ..... 473/451; 473/422; 124/78; 124/81

(58) Field of Search ..... 40/327; 473/256, 473/267, 268, 353, 384, 447, 451, 351, 378, 598, 600; 273/DIG. 24; D21/713; 124/6, 7, 78, 81, 82, 50, 41.1

(56) References Cited

U.S. PATENT DOCUMENTS 4,235,441 A * 11/1980 Ciccarello ..... 473/268
4,256,304 A * 3/1981 Smith et al. ..... 473/451
4,991,838 A * 2/1991 Groves ..... 473/451
5,711,725 A * 1/1998 Bengtson ..... 473/451
5,762,573 A * 6/1998 Kennedy, III et al. ..... 473/570

* cited by examiner

*Primary Examiner*—Paul T. Sewell
*Assistant Examiner*—Mitra Aryanpour
(74) *Attorney, Agent, or Firm*—Grimes & Battersby, LLP

(57) ABSTRACT

A baseball is provided for repeated use with a pitching machine. The baseball has a smooth surface upon which a plurality of dimples or indentations are provided, said indentations being spaced in a regular pattern. These indentations serve to induce turbulent airflow over the surface of the baseball, thereby reducing the drag on the ball and serving to stabilize the flight of the ball. The ball further includes a plurality of slot-shaped depressions formed in a pattern similar to the stitch pattern of an actual baseball and wherein the inner surfaces of said slot-shaped depressions are colored with a dye or paint such that the rotational velocity of the baseball may be observed when the ball is in flight.

11 Claims, 2 Drawing Sheets

BALL FOR PITCHING MACHINE

BACKGROUND OF THE INVENTION

1. Field of the Invention

The present invention relates generally to sports balls, and more particularly to baseballs for use in ball-throwing machines, particularly of the type having at least one drive wheel. The ball has particular applicability as a baseball for a pitching machine for both professional and amateur athletes in that it realistically recreates the stitching pattern on regulation baseballs so as to allow a batter to identify the rotation of the ball in flight.

2. Description of the Prior Art

Pitching machines and ball-throwing machines are well-known in the art and generally fall into four categories: (1) machines that employ a spring actuated arm mechanism to propel the ball; (2) machines that employ at least one rotating wheel or a pair of rotating, coacting wheels to propel the ball; (3) machines that rely on pneumatic pressure to propel the ball; and (4) machines that employ converging and diverging rotatable discs to propel the ball.

Examples of ball-throwing machines that employ a spring mechanism to propel the ball are described, for example, in U.S. Pat. No. 3,757,759 which issued on Sep. 11, 1973 to J. G. Haworth for Automatically. Varied Oscillation Type Ball Projecting Device and U.S. Pat. No. 4,524,749 which issued on Jun. 25, 1985 to Paul S. Giovagnoli for Spring-Type Ball Pitching Machine. Commercial versions of such a machine have been marketed by Master Pitching Machine of Kansas City, Mo.

In recent years, the majority of the commercially available ball-throwing or pitching machines employ one or two coacting rotating wheels which are used to propel a ball that is introduced into the nip between the rotating wheels or between a plate and a single rotating wheel. Examples of such machines are described in U.S. Pat. No. 3,724,437 which issued on Apr. 3, 1973 to E. W. Halstead for Ball-throwing Machine; U.S. Pat. No. 3,815,567 which issued on Jun. 11, 1974 to Norman S. Serra for Coacting Wheel Ball Projecting Device; U.S. Pat. No. 4,197,827 which issued to Tommy L. Smith on Apr. 15, 1980 for Coacting Wheel Ball Projecting Device; U.S. Pat. No. 4,423,717 which issued to Edward W. Kahelin on Jan. 3, 1984 for Variable Double Wheel Ball Propelling Machine; U.S. Pat. No. 4,583,514 which issued to Fujio Nozato on Apr. 22, 1986 for a Ball-throwing Machine; and U.S. Pat. No. 4,922,885 which issued to Shigery Iwabuchi et al. on May 8, 1990 for a Pitching Machine. Commercial machines that employ a pair of rotating coacting wheels are marketed by The Jugs Company of Tualatin, Oregon, ATEC of Sparks, Nev., AAI American Athletic, Inc. of Jefferson, Iowa, K-Lin Specialties, Inc. of Huntington Beach, Calif. and OMNI Sports Technologies of Kansas City, Mo.

A problem with such ball-throwing machines, particularly those which utilize coacting wheels, is that regulation baseballs often cannot be used, for a variety reasons. Primary among such reasons is that the stitching on the surface of the ball interferes with the driving means such that the balls are hot accurately thrown. Accordingly, specially-designed balls have been designed for use with such ball-throwing machines. For example, U.S. Pat. No. 4,256,304, which issued to Smith, et al. on Mar. 17, 1981 for a "Baseball" discloses a baseball suitable for continuous use in a pitching machine comprising a molded, resilient polyurethane foam sphere having a smooth polyurethane surface skin, with the surface of the sphere being provided with a regular pattern comprising a multiplicity of cup-like or hemispherical depressions substantially covering the surface.

However, these specially designed balls do not accurately simulate regulation baseballs in that there is no stitching by which a batter may determine the angular rotation of the ball.

SUMMARY OF THE INVENTION

Against the foregoing background, it is a primary object of the present invention to provide an improved ball for use in a pitching machine that includes a stitching pattern for a batter to determine the angular rotation of the ball in flight.

It is another object of the present invention to provide such a ball that is durable so as to withstand the continued, high-stress use in a pitching machine and being struck by a bat.

It is yet another object of the present invention to provide such a ball that physically resembles a regulation baseball in size and weight, as well as appearance.

It is still another object of the present invention to provide such a ball that is inexpensive to manufacture.

It is another object of the present invention to provide such a ball that induces turbulent airflow over the surface thereof so as to reduce drag and increase accuracy.

To the accomplishments of the foregoing objects and advantages, the present invention, in brief summary, comprises a ball for use with a pitching machine, said ball having a smooth surface in which a plurality of indentations or dimples are regularly spaced. The inner surfaces of one or more of these indentations is colored with a dye or paint such that the rotational velocity of the baseball may be determined when the ball is in flight. The colored indentations are patterned so as to simulate the stitching on a regulation baseball. In a particularly preferred embodiment, a plurality of recessed slots are provided to simulate the stitch pattern of an actual baseball, and the inner portion of such recessed slots are colored with a paint or dye to provide a visual impression of stitching.

BRIEF DESCRIPTION OF THE DRAWINGS

The foregoing and still other objects and advantages of the present invention will be more apparent from the detailed explanation of the preferred embodiments of the invention in connection with the accompanying drawings, wherein.

BRIEF DESCRIPTION OF THE PREFERRED EMBODIMENTS

Figure 1:
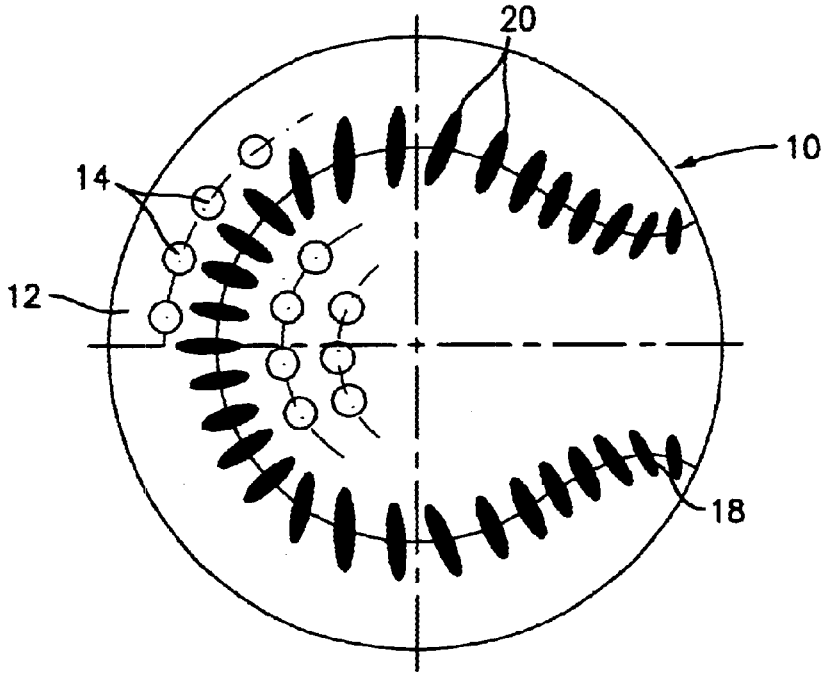
FIG. 1 is a side elevational view of the ball of the present invention.
Figure 2:
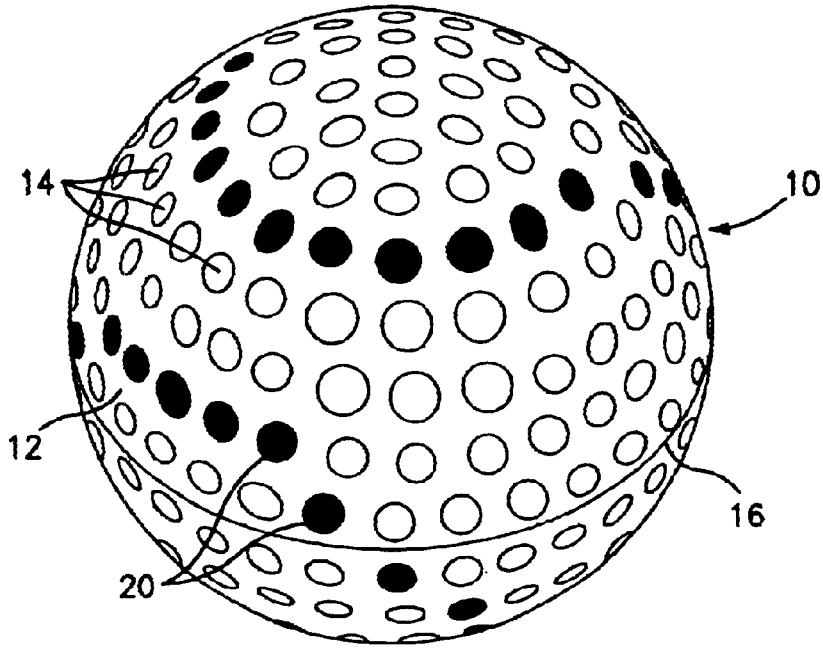
FIG. 2 is a perspective illustration of an alternative embodiment of the ball of the present invention showing an alternative indentation design and pattern.
Figure 3:
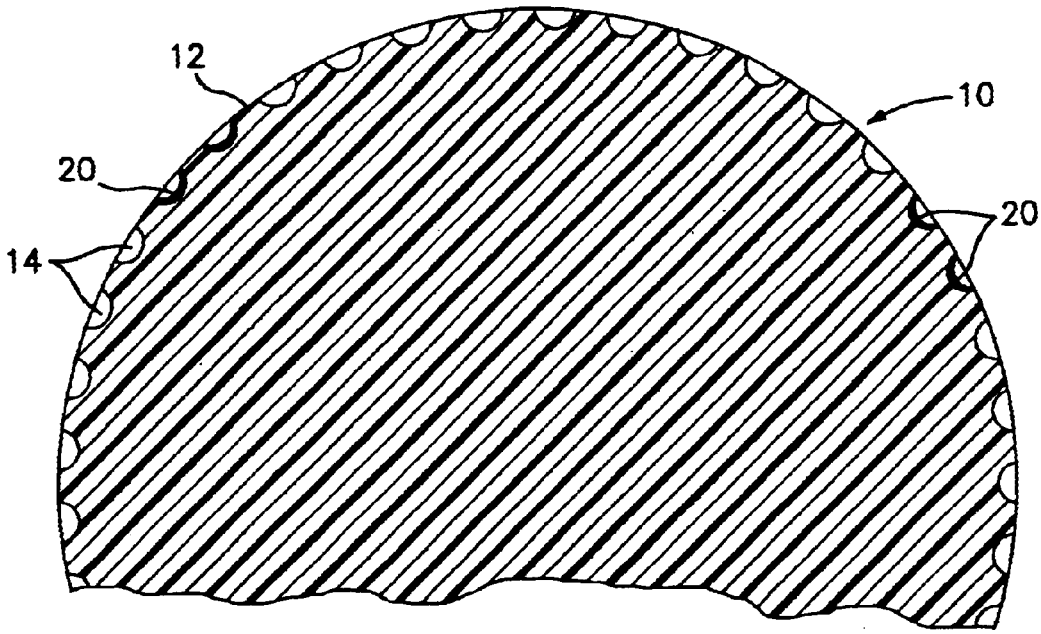
FIG. 3 is a cross-sectional view of the ball of FIG. 1 taken through the center thereof.
Figure 4:
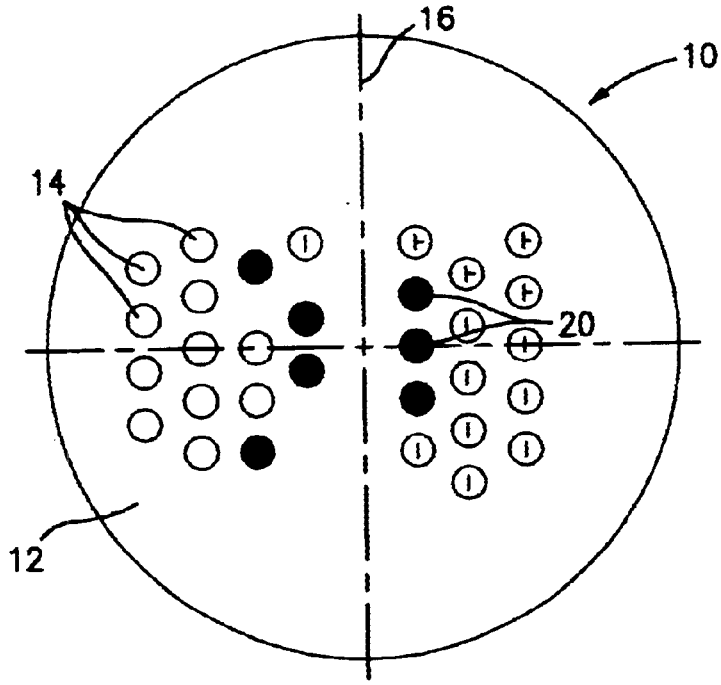
FIG. 4 is a side elevational view of the ball of FIG. 2 showing the pattern of colored indentations.

Referring to the drawings and, in particular, to FIGS. 1 and 2 thereof, the ball of the present invention is provided and is referred to generally by reference numeral 10. In the preferred embodiment, the ball 10 is composed of a urethane foam having a uniform density throughout its cross-section. The ball 10 is spherical, having a diameter of approximately 2⅞ inches (+/−0.01 inch) and having a maximum hardness of between about 50 and 100 on the type A-2 Shore durometer scale and preferably between about 70 and 80 on the A-2 Shore durometer scale. The weight of ball 10 is between 4.5 and 5.0 ounces, preferably approximately 5.0 ounces. Strict compliance with these measurements is required so as to accurately reproduce the dimensions, weight and hardness of a regulation baseball.

The ball 10 has a smooth outer surface 12 in which a plurality of depressions or "dimples" 14 are provided in a regular pattern. The majority of these depressions 14 are semi-spherical in shape, having a diameter or width between 0.10 and 0.18 inches, a depth of approximately 0.08 inches and a radius of curvature of between 0.05 and 0.10 inches. In the preferred embodiment, these depressions are 0.10 inches wide, 0.08 inches deep, and having a radius of curvature of 0.08 inches.

The depressions 14 cover the entire surface 12 of ball 10 and are organized in rows that run parallel with the equator 16 of the ball 10. The spacing between depressions 14 is between 0.05 and 0.18 inches. In a regulation size ball 10 there will be approximately 250 to 500 depressions 14.

As with golf balls, these depressions 14 serve to interrupt laminar air flow over the surface of the ball 10 in flight and induce turbulent air flow. The result of this induced turbulence is reduced drag on the ball 10, which allows the ball 10 to travel farther and with greater accuracy.

In the preferred embodiment, a number of depressions 14 take the form of recessed slots 18 which are disposed in a pattern so as to simulate the stitching of a regulation baseball. The use of slots 18 more accurately recreates the shape of the stitching in a regulation baseball. However, it should be appreciated that the entire surface of the ball 10 may be covered with uniform semi-spherical depressions 14. The length of each of these recessed slots 18 is between about 0.30 and about 0.50 inches and the width of each of said recessed slots is between about 0.05 and about 0.15 inches. The depth of each of these recessed slots is between about 0.05 and about 0.20 inches. In the preferred embodiment, these slots would be 0.375 inches long by 0.10 inches wide by 0.05 inches deep, and have a radius of curvature at the ends of 0.05 inches. The spacing between slots 18 is between 0.10 and 0.20 inches, and in the preferred embodiment there are 118 slots 18 covering the surface of the ball 10 in the regulation ball stitching pattern.

Disposed within the slots 18, or, alternatively, within one or more of the indentations 14, is coloration or paint 20 such that the rotational velocity of the ball 10 may be determined when ball 10 is in flight by observing the movement and rotation of slots 18 or those indentations 14 containing paint 20. As indicated, in the preferred embodiment, the slots 18 are patterned so as to simulate the stitching on a regulation baseball. Alternatively, the indentations 14 containing paint 20 may similarly be arranged so as to simulate the baseball's stitching pattern. The color of such paint 20 in such embodiment would be red, so as to simulate the red threads in the stitching.

It should be appreciated that paint 20 should be situated at the base of slots 18 or indentations 14 and should not reach the surface 12 of ball 10. If paint 20 were to reach the surface 12 of ball 10, the paint 20 would disrupt the smooth surface 12 of the ball 10, thereby potentially interfering with the drive mechanism of a pitching machine, or even rub off on such drive mechanism.

Having thus described the invention with particular reference to the preferred forms thereof, it will be obvious that various changes and modifications can be made therein without departing from the spirit and scope of the present invention as defined by the appended claims.

We claim:

1. A ball for use with a pitching machine, said ball having a substantially smooth surface of a uniform color, a plurality of semi-spherical depressed dimples provided about said surface, and a plurality of elongated, slot-shaped recesses arranged in a pattern about said outer surface simulating the stitching on a baseball, wherein said recesses each include a colored pigment different from the color of said surface below the outer surface of said ball, thereby preventing said pigment from being transferred to said pitching machine.

2. The ball of claim 1, wherein said ball is composed of urethane having a uniform density throughout.

3. The ball of claim 1, wherein said the hardness of said ball is between about 50 and about 100 on the type A-2 shore durometer hardness scale.

4. The ball of claim 3, wherein said the hardness of said ball is between about 70 and about 80 on the type A-2 shore durometer hardness scale.

5. The ball of claim 1, wherein the diameter of said ball is approximately two and seven-eighths inches.

6. The ball of claim 1, wherein the length of each of said slot-shaped recesses is between about 0.30 and about 0.50 inches and the width of each of said slot-shaped recesses is between about 0.05 and about 0.15 inches.

7. The ball of claim 1, wherein the depth of each of said slot-shaped recesses is between about 0.05 and about 0.20 inches.

8. The ball of claim 1, wherein the diameter of each of said semi-spherical depressed dimples is between about 0.10 and about 0.18 inches.

9. The ball of claim 1, wherein the depth of each of said semi-circular depressed dimples is approximately 0.08 inches.

10. The ball of claim 1, wherein said pigment is red.

11. A urethane ball for use with a pitching machine, the diameter of which is about 2⅞ inches, said ball have a substantially smooth outer surface of a uniform color, a plurality of semi-spherical depressed dimples provided about said outer surface with a diameter of between about 0.10 and 0.18 inches the color of said dimples being the same color as the color of said outer surface of said ball, and a plurality of elongated, slot-shaped recesses arranged on the outer surface of said ball in a pattern simulating the stitching of an actual baseball, said elongated slot-shaped recesses containing a colored pigment different from the color of said ball surface and said dimples, said pigment being provided within said elongated slot-shaped recesses and below the surface of said ball such that none of said pigment extends onto said outer surface, thereby preventing said pigment from being transferred to said pitching machine.

* * * * *